US005816789A

United States Patent [19]

Johnson

[11] Patent Number: 5,816,789

[45] Date of Patent: Oct. 6, 1998

[54] ROTARY PUMP/ENGINE

[76] Inventor: David W. Johnson, 3234 E. 43rd St., Indianapolis, Ind. 46205

[21] Appl. No.: 680,682

[22] Filed: Jul. 17, 1996

Related U.S. Application Data

[60] Provisional application No. 60/001,484 Jul. 18, 1995.

[51] Int. Cl.[6] ..... F01C 1/12; F03C 2/12

[52] U.S. Cl. ..... 418/227

[58] Field of Search ..... 418/188, 227

[56] References Cited

U.S. PATENT DOCUMENTS

| | | | |
|---|---|---|---|
| 5,090,501 | 2/1992 | McNulty | 418/227 |

FOREIGN PATENT DOCUMENTS

| | | | |
|---|---|---|---|
| 47-23495 | 6/1972 | Japan | 418/227 |
| 426675 | 4/1935 | United Kingdom | 418/227 |
| 882262 | 11/1961 | United Kingdom | 418/227 |
| 2077857 | 12/1981 | United Kingdom | 418/227 |

*Primary Examiner*—Michael Koczo

*Attorney, Agent, or Firm*—Johnson, Smith, Pence, Densborn, Wright & Heath

[57] ABSTRACT

A rotary machine, with no reciprocating parts, for expansion motors and pumps includes a machine housing, a flattened, cylindrical flywheel disposed within the housing, a piston secured to one side of the flywheel, a flattened, cylindrical plate positioned to the underside of the flywheel, the plate including a toroidal channel in the outer portion of the plate for disposing the piston within the toroidal channel, a recess portion in the middle of the plate, one inlet port entering through the main shaft with an aperture at the back side of the piston with said inlet port disposed within the toroidal channel, and two exhaust ports within the plate with one aperture of each of said exhaust ports disposed within the toroidal channel, two rotating valves contained within the recess portion of the plate, said rotating valves secured to secondary shafts, a main shaft secured to the flywheel and the secondary shafts for providing output power from the engine.

1 Claim, 9 Drawing Sheets

ROTARY PUMP/ENGINE

This application claims benefit of USC Provisional Application No. 60/081484, filed Jul. 18, 1995.

FIELD OF THE INVENTION

The present invention relates generally to the design of a rotary piston engine that can be operated as an expansion motor or as a rotary pump by converting externally supplied fluid pressure into mechanical motion or alternatively, converting mechanical motion into fluid pressure.

DESCRIPTION OF THE PRIOR ART

While there are many rotary designs in the prior art, the present invention uses a different concept that results in simplicity of design (a small number of moving parts that all operate in a circular motion), increased reliability and life of the components and improved performance.

One example of a prior rotary engine scheme is disclosed in U.S. Pat. No. 5,359,971 naming Espie Haven as the inventor In the aforementioned U.S. Patent, a device is disclosed in which the rotating valves exist in the form of spring-loaded, retractable hinged vanes. There are several problems with this type of arrangement. Depending on the fluid used and the size of the engine, the force of the fluid can exert a significant pressure on the hinged vane and the hinge itself. Also, the spring will have to withstand the force exerted. This arrangement will decrease the life and reliability and perhaps limit the size of the engine. With more moving parts, the cost will also increase. The reciprocating motion of the hinge and the number of parts will also decrease the efficiency of the engine.

The present invention represents an improvement over the prior art primarily due to the superior design of the valve arrangement, the decrease in the number of moving parts and the total elimination of any reciprocating parts.

SUMMARY OF THE INVENTION

The primary object of the present invention is to provide a rotary engine with no reciprocating components. The present invention provides greatly increased torque over other existing engines and is only limited by the pressure and surface area of the piston, the length of the radius about which the piston rotates and the volume and pressure of the fluid delivered to the engine.

Another object of the present invention is to make the engine extremely versatile. The engine can be made very large or very small and can also be made from an assembly of several separate sections of the engine. The power and torque generated are proportional to the component size and the engine is easily scaled to the appropriate size for the application.

Another object of the present invention is to eliminate all reciprocating parts. With this concept there is no energy loss caused by inertia. In other words, no part has to decelerate, stop, change direction and accelerate as would many parts in a typical engine configuration.

Another object of the present invention is to eliminate the number of moving parts to increase reliability and decrease manufacturing cost.

These objects are accomplished by the present invention, a rotary machine for expansion motors and pumps, comprising a machine housing with a flattened, cylindrical flywheel disposed within the housing, a piston secured to one side of the flywheel, and flattened, cylindrical plate in close proximity to the flywheel, the plate including a toroidal channel in the outer portion of the plate for disposing the piston within the toroidal channel, a recess portion in the middle of the plate, an inlet port entering through the main shaft and with an aperture on the back side of the piston for introducing a fluid to the toroidal channel and a plurality of exhaust ports within the plate with one aperture of each of the exhaust ports disposed within the toroidal channel, a plurality of rotating valves contained within the recess portion of the plate, the rotating valves secured to a plurality of secondary shafts, a main shaft secured to the flywheel and the secondary shafts for providing output power and for controlling the inlet port and the exhaust ports with the rotation of the rotating valves and a means for introducing and exhausting a fluid to the toroidal channel for providing power to the piston.

BRIEF DESCRIPTION OF DRAWINGS

In order that the invention can be more clearly ascertained, examples of preferred embodiments will now be described with reference to the accompanying drawings.

DESCRIPTION OF PREFERRED EMBODIMENT

Figure 1:
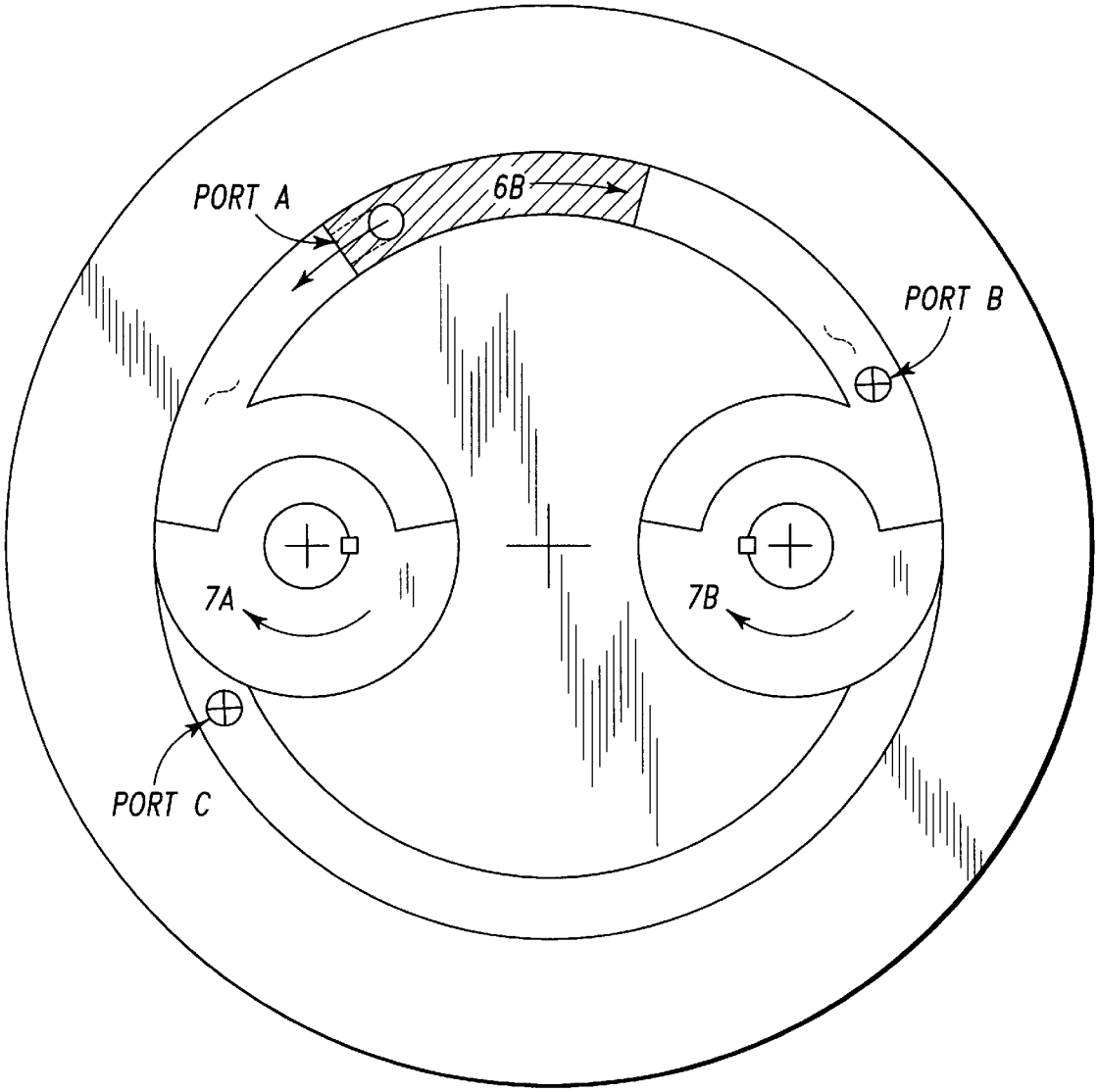
FIG. 1 is an elevational view of the rotary valves and piston showing the relative location at 0 degrees of rotation.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In order to better visualize the basic concept and operation of this invention, simplified drawings, FIGS. 1 through 5, are shown to depict the operation of the device given different positions of the piston and the rotating valves.

Referring now to FIG. 1, the rotating valves 7A and 7B, which are circular in design, are shown in the starting position or 0 degrees such that intake port A and exhaust ports B and C are all in an open position. This position allows a fluid to enter the toroidal channel through inlet port A behind the piston 6B forming a pressurized chamber such that sufficient pressure is created in the pressurized chamber to cause the piston 6B to rotate in a clockwise direction within the toroidal channel. The pressurized chamber is formed on the one end by the rotary valve 7A and on the other end by the backside of the piston 6B. This port A being on the backside of piston 6B gives an added advantage because of the additional thrust in the pressurized chamber. This embodiment further includes rotating valves 7A and 7B in the form of circular disks that have a small radius portion of 180 degrees or less and a large radius portion around the circumference for the remaining 180 degrees or more such that the large radius portion contacts the outside wall of the toroidal channel as the rotating valves 7A and 7B travel in a clockwise direction and the toroidal channel is alternately blocked and open depending on the position of the rotating valves 7A and 7B. Not shown in this FIG. 1, but necessary as a background to understanding the drive mechanism and described in FIGS. 6 and 7, a main shaft is attached to the flywheel assembly. This main shaft is connected to the rotary valve shafts by sprockets and chain, gears, or other similar methods such that the main shaft drives the rotary valves at the same speed as the main shaft. That is, if the piston rotates 30 degrees the rotary valves rotate 30 degrees. The toroidal channel is progressively blocked or open depending on the position of the valves 7A and 7B. The large radius portion travels against the outside wall of the toroidal channel such that the toroidal channel is blocked when the large radius portion comes into contact with the outside wall of the toroidal channel. Conversely, the smaller radius portion travels along the inside wall of the toroidal channel such that when the small radius portion is in position along the inside wall of the toroidal channel, the toroidal channel remains open. In general, when the large radius portion is rotated within the toroidal channel, the toroidal channel becomes increasingly restricted to fluid flow. Since the rotating valves 7A and 7B are positioned in the starting position, rotating valve 7A is positioned such that fluid is prevented from flowing to the bottom of the toroidal channel and the fluid is not allowed to escape the exhaust chamber through the exhaust port C, but may escape through exhaust port B. The exhaust chamber is formed on one end by the frontside of the piston 6B and on the other end by rotary valve 7B. As the piston 6B moves around the toroidal channel, the rotating valves 7A and 7B also rotate, regulating the fluid flow to the exhaust ports. Subsequent illustrations will demonstrate the various positions of the rotating valves 7A and 7B and resulting port openings and closing. The piston 6B is designed in a shape similar to the toroidal channel such that the piston 6B is something less than 180 degrees of the circumference of the midline of the toroidal channel and is allowed to travel clockwise or counterclockwise within the toroidal channel. The piston 6B and toroidal channel may be of a round, square or other similar cross-section design. In this particular example, the piston 6B is 50 degrees of the circumference of the toroidal channel and is traveling in a clockwise direction and is square in cross-section.

Figure 2:
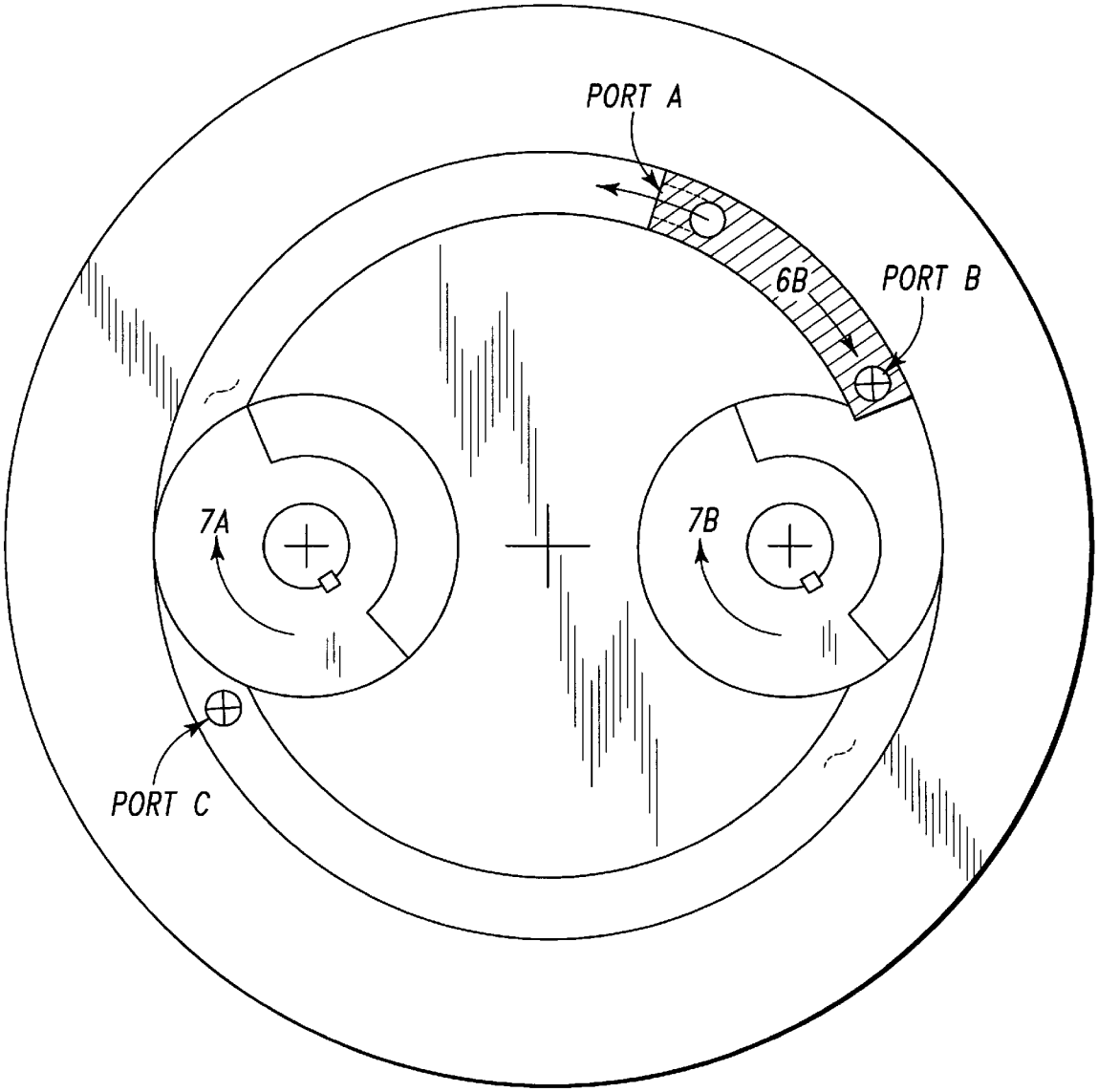
FIG. 2 is an elevational view of the rotary valves and piston showing the relative location at 55 degrees of rotation.

FIG. 2 shows the rotating valves 7A and 7B moved in a clockwise direction to the 55 degree position. In this position, intake port A and exhaust port C are in an open position and exhaust port B is in a closed position. The piston 6B is located in the top right portion of the toroidal channel. Fluid enters intake port A and pressurized chamber exerting pressure on the backside of the piston 6B causing the piston 6B to continue its clockwise rotation around the toroidal channel. As rotating valve 7B rotates, an opening is created such that the fluid in exhaust chamber can flow between the edge of the large radius portion of rotating valve 7B and the outside wall of the toroidal channel thus allowing the exhaust from exhaust chamber to escape through exhaust port C and extending the end of the exhaust chamber to rotary valve 7A.

Figure 3:
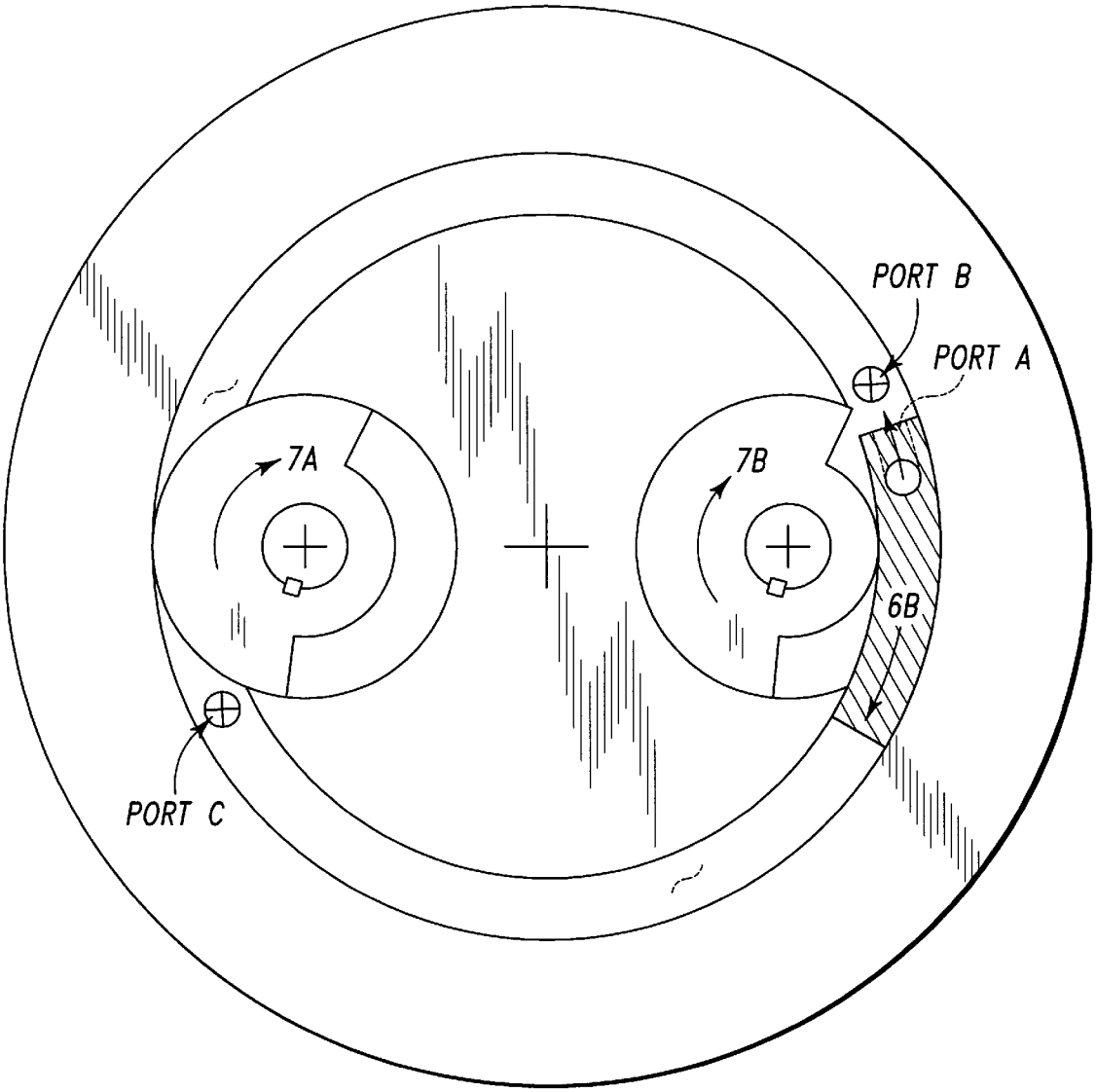
FIG. 3 is an elevational view of the rotary valves and piston showing the relative location at 105 degrees of rotation.

Referring now to FIG. 3, the rotating valves 7A and 7B have been rotated to the 105 degree position. In this position, the piston 6B is located on top of the small radius portion of rotating valve 7B. Intake port A and exhaust port C are in an open position and exhaust port B is in a closed position. Fluid is entering intake port A and pressurized chamber thus maintaining pressure to the back of piston 6B while exhaust ahead of the piston 6B in exhaust chamber is allowed to escape through exhaust port C. Rotating valve 7A is rotated such that the large radius portion blocks the toroidal channel and does not allow the exhaust chamber to extend beyond exhaust port C.

Figure 4:
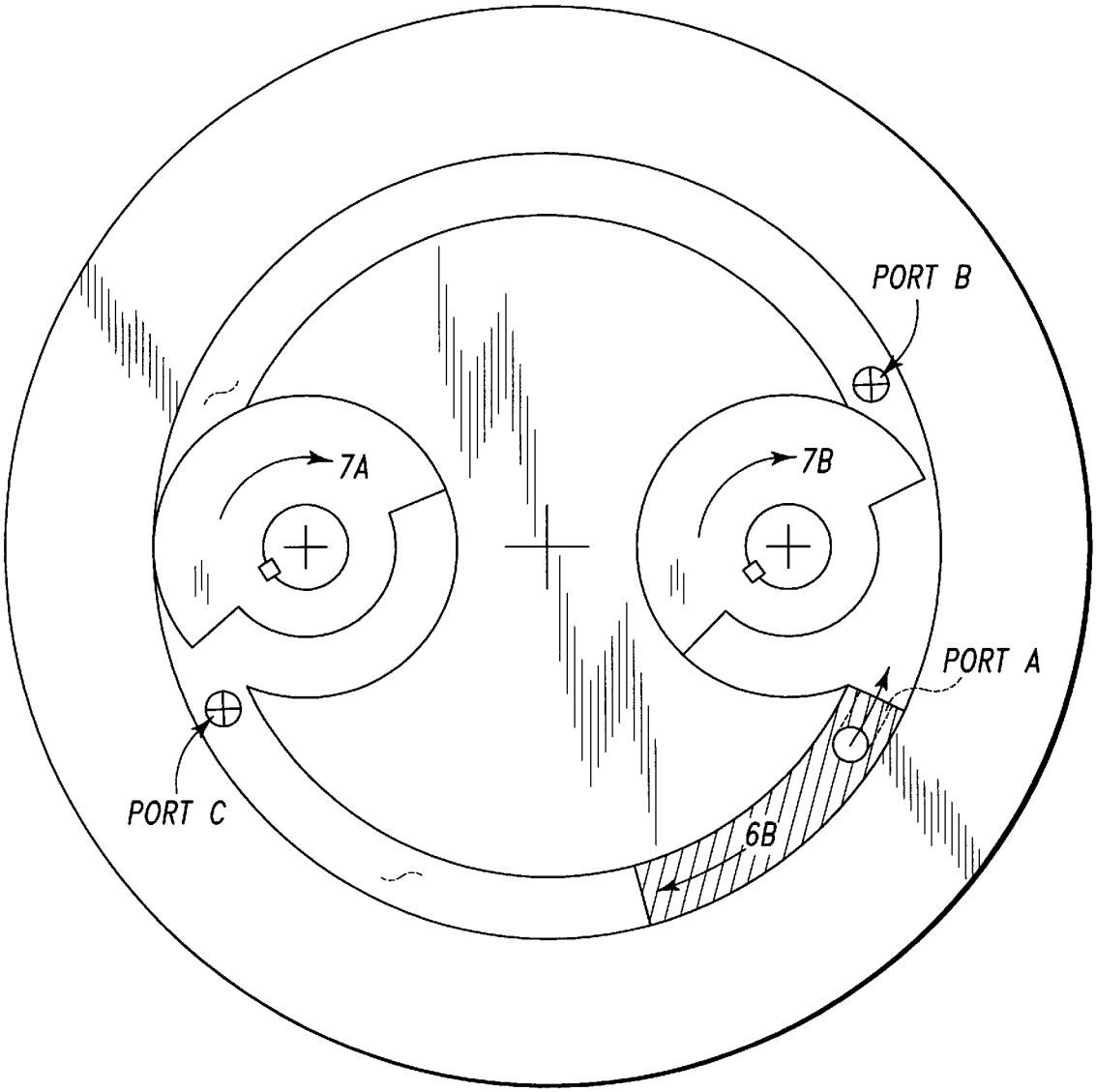
FIG. 4 is an elevational view of the rotary valves and piston showing the relative location at 150 degrees of rotation.

Referring now to FIG. 4, the rotating valves 7A and 7B are shown in the 150 degree position. Intake port A and exhaust port C are in an open position and exhaust port B is in a closed position. The piston 6B has traveled just beyond rotating valve 7B within the toroidal channel. Rotating valve 7B has rotated such that large radius portion of rotating valve 7B has significantly restricted flow through the toroidal channel. Rotating valve 7A is rotated such that the toroidal channel is entirely restricted at that position. Exhaust is then forced to exit through exhaust port C.

Figure 5:
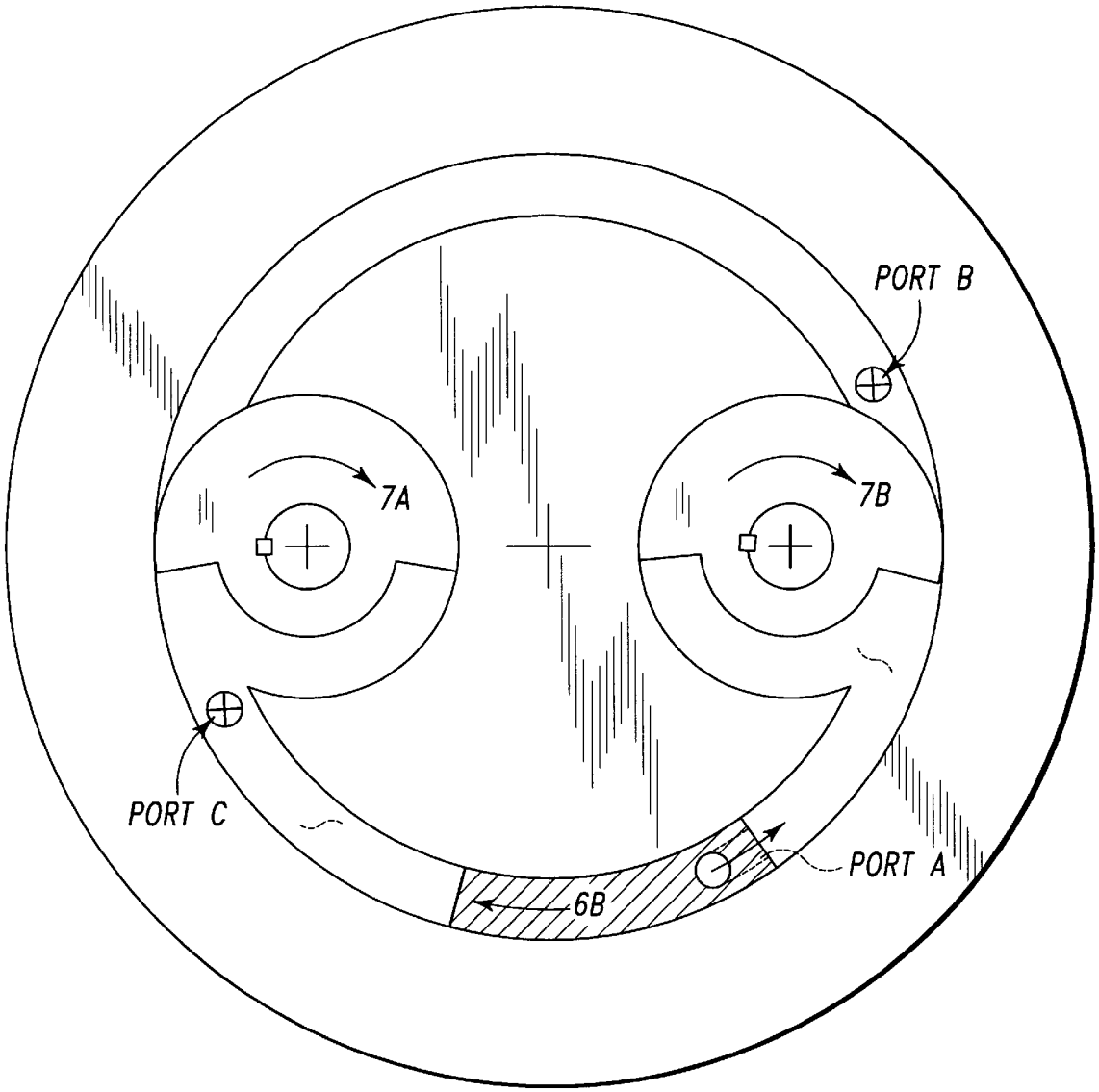
FIG. 5 is an elevational view of the rotary valves and piston showing the relative location at 180 degrees of rotation.

Referring now to FIG. 5, the rotating valves 7A and 7B are in the 180 degree position. Intake port A and exhaust ports B and C are in an open position. The piston 6B is at the bottom of the toroidal channel. Fluid is allowed to enter intake port A and must exhaust through exhaust port C since rotating valve 7A remains in a position which prevents fluid flow through the toroidal channel.

As FIGS. 1 through 5 illustrate, fluid flow and pressure are maintained throughout the clockwise travel of the piston 6B and exhaust is consistently allowed to escape, thus maintaining the speed of the piston 6B around the toroidal channel- The sequence of events described above continues throughout the entire 360 degrees of rotation around the toroidal channel. When piston 6B is positioned between 180 degrees and 360 degree of rotation within the toroidal channel, the previous steps described in FIGS. 1 through 5 are repeated except the function of the valves 7A and 7B are reversed as the piston travels to the left side of the toroidal channel.

Figure 6:
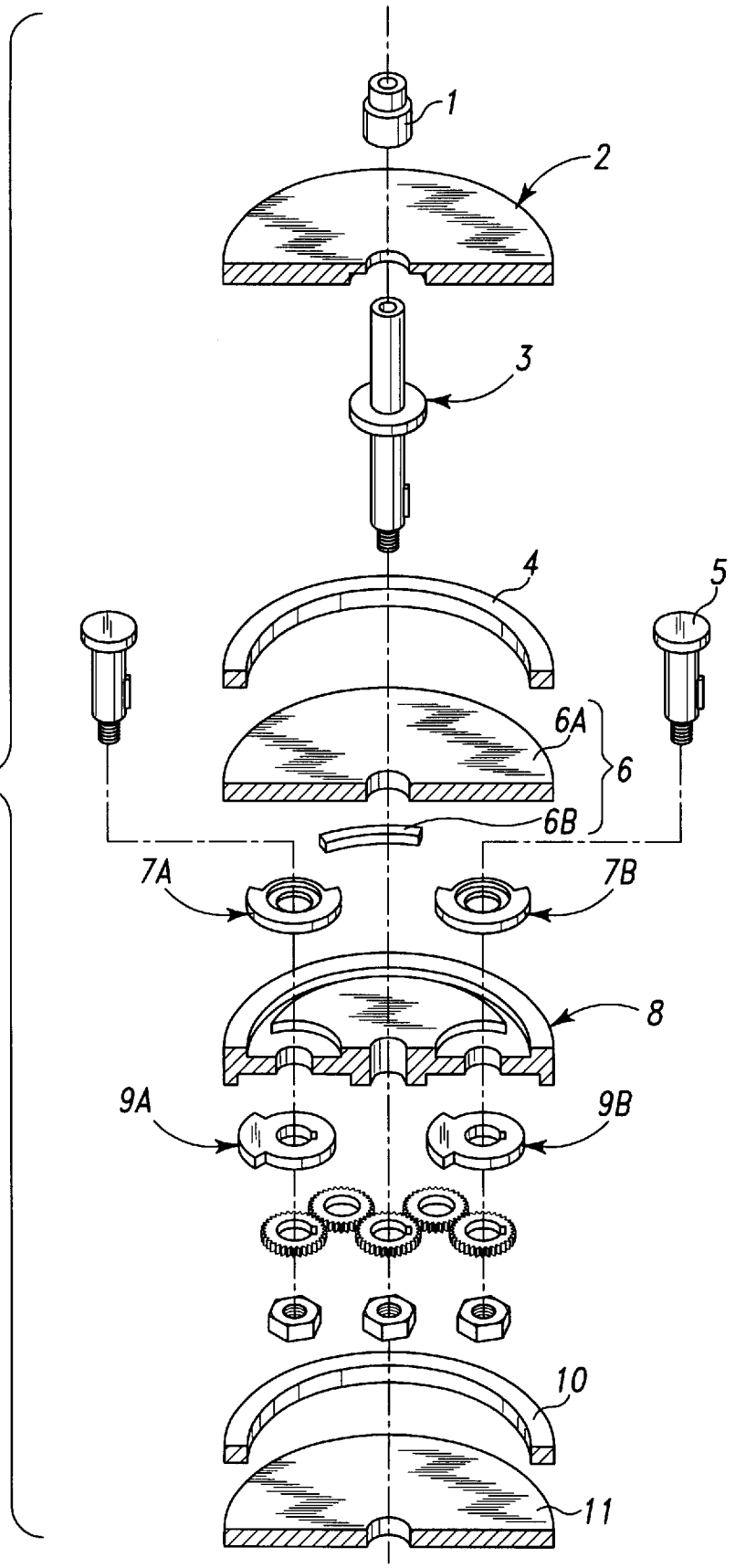
FIG. 6 is an exploded view of the rotary piston engine according to an embodiment of the present invention.
Figure 7:
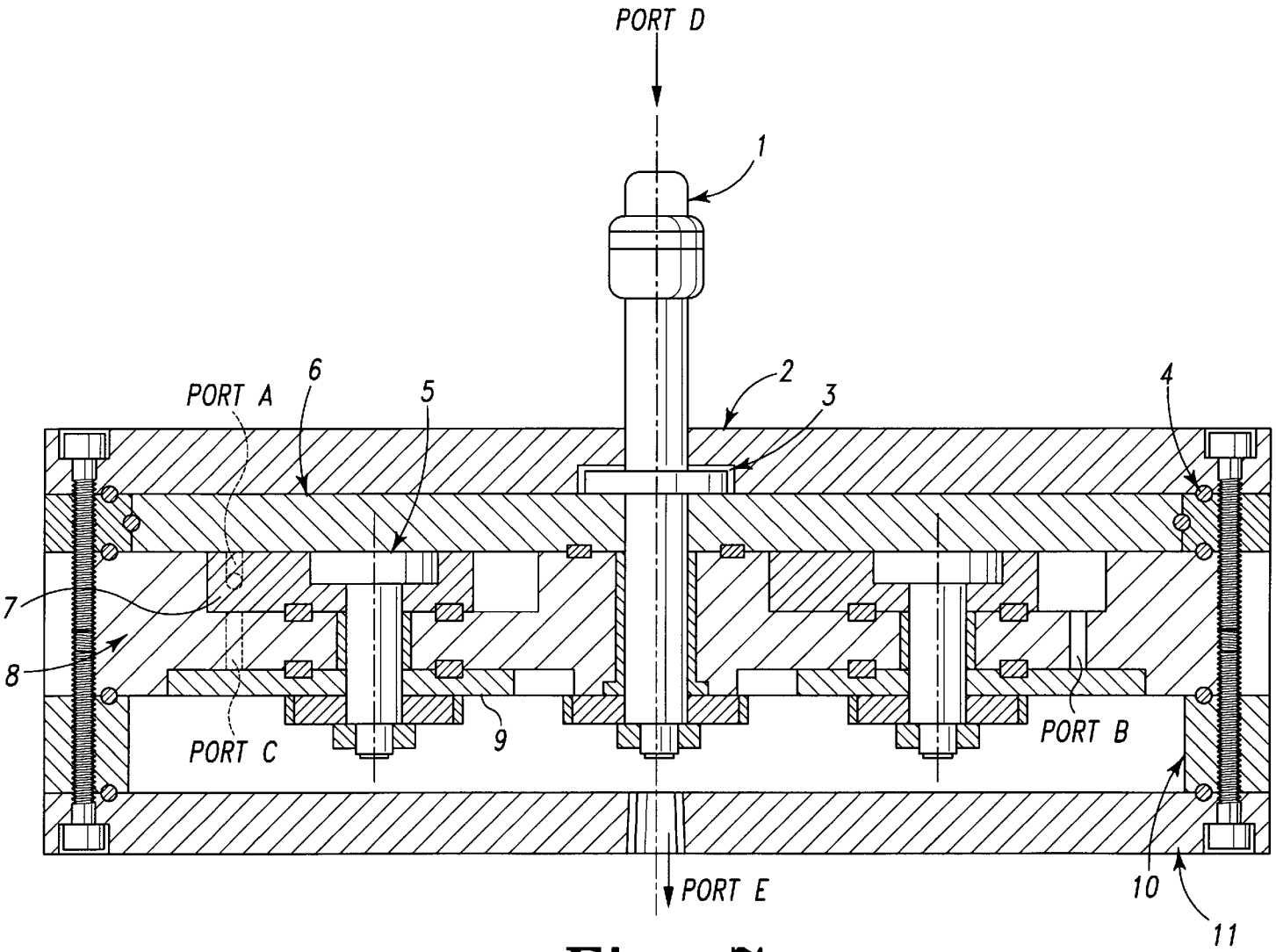
FIG. 7 is a cross sectional view of the rotary piston engine according to an embodiment of the present invention.

Referring now to FIGS. 6 and 7 exploded view and sectional view respectively, of the rotary piston engine shown in this embodiment. A rotary piston device is shown which includes a commercially available rotary union 1, a main shaft 3, a top plate 2, a top spacer 4, a toroidal channel and valve seat plate 8, a plurality of rotary valves 7A and 7B, a second set of rotary valves 9A and 9B, a flywheel assembly 6, a bottom ring 10 and a bottom plate 11. The top plate 2, a top spacer 4, a toroidal channel and valve seat plate 8, a flywheel assembly 6, a bottom ring 10 and a bottom plate 11. The top plate 2, a top spacer 4, a toroidal channel and valve S seat plate 8, a flywheel assembly 6, a bottom ring 10 and a bottom plate 11 form the main structure or machine housing of the rotary piston device. A fluid enters intake port D at the top of the main shaft 3. A fluid channel is bored, drilled or produced by similar means through the center of the main shaft 3 and continues through the center of the flywheel assembly 6. The flywheel assembly may include a flywheel 6A and a piston 6B secured to the flywheel 6A. The fluid channel continues through the center of the flywheel 6A and the piston 6B such that the fluid is released from the back of the piston 6B into the pressurized chamber within the toroidal channel. This arrangement provides forces to the piston 6B as described in FIGS. 1 through 5 that allowed the piston 6B to travel within the toroidal channel. An added advantage is the additional thrust force that is created when the fluid is released from the back of the piston 6B. The exhaust is channeled out of two exhaust ports B and C in a manner as described previously in FIGS. 1 through 5. The exhaust leaves the exhaust chamber within the toroidal channel and travels through the bottom ring 10 until the exhaust reaches an exhaust port E that is formed through the middle of the bottom plate 11. The exhaust may be removed from exhaust port E by any number of conventional processes that should be well known to those skilled in the art.

Figure 8:
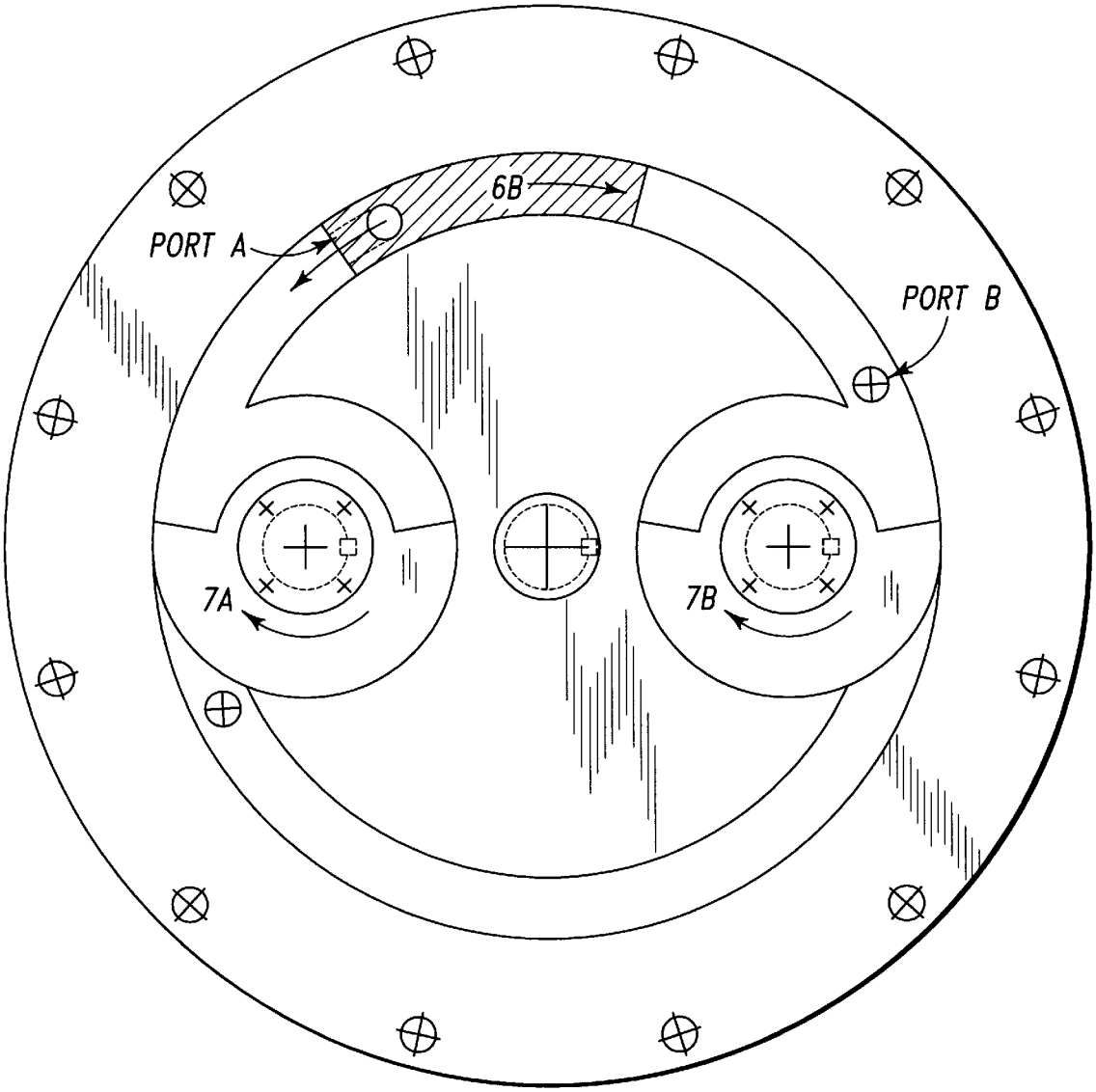
FIG. 8 is an elevational top view of the toroidal channel and valve seat plate with a set of rotating valves shown in position of the apparatus of FIG. 6.

Referring now to FIG. 8 top view of the toroidal channel and valve plate shown in the embodiment. In this embodiment, a toroidal channel and two recessed areas or valve seats are formed in the top of the toroidal channel and valve seat plate 8 such that a set of rotating valves 7A and 7B can be placed within and allowed to rotate within the recessed areas and piston 6B can be placed in the toroidal channel and allowed to rotate within the recessed area. Their operation and sequence is described in FIGS. 1 through 5.

Figure 9:
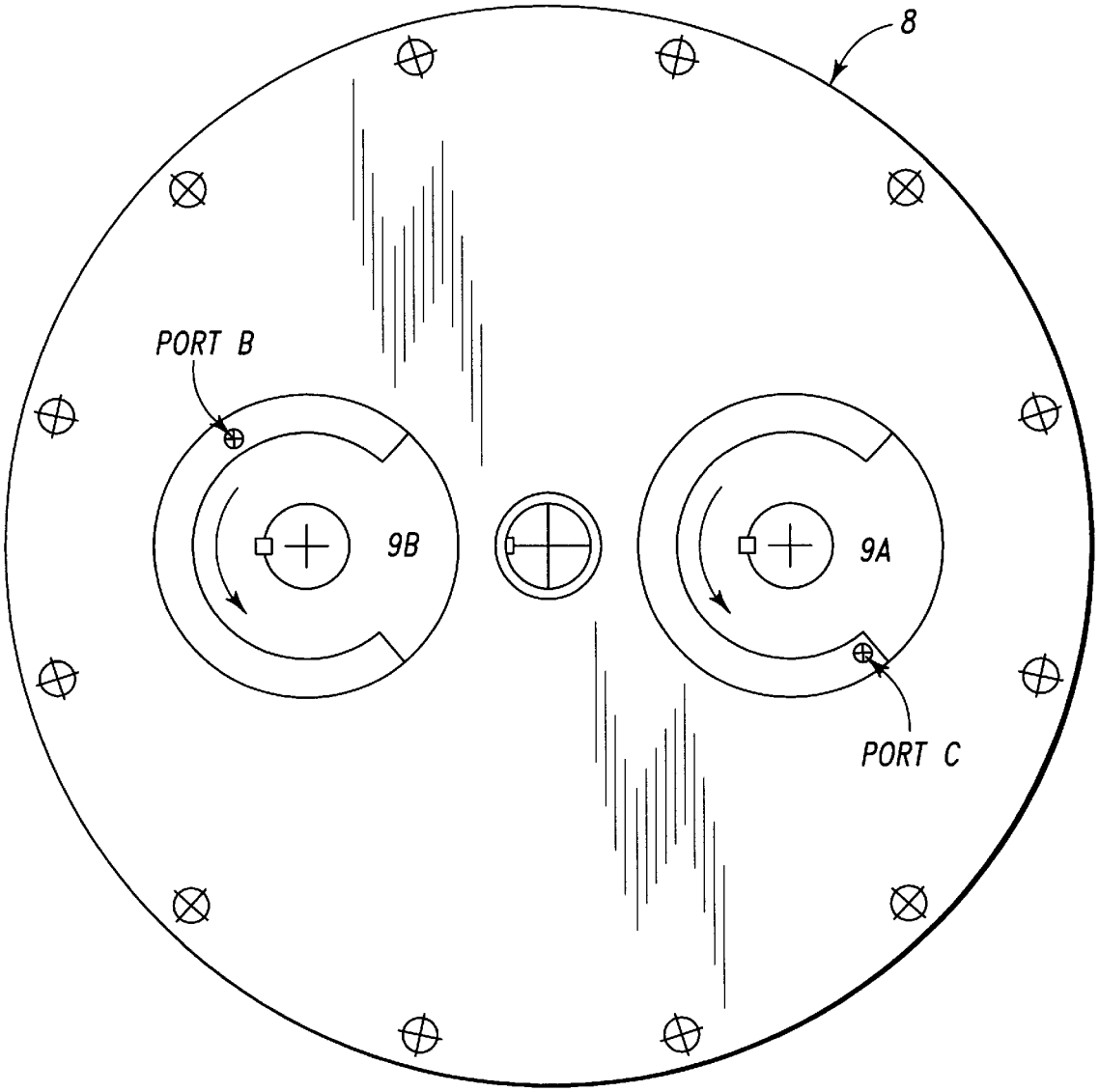
FIG. 9 is an elevational bottom view of toroidal channel and valve seat plate, with a set of rotating valves shown in position of the apparatus of FIG. 6.

Now referring to FIG. 9, a bottom view of the toroidal channel and valve plate are shown in the embodiment.

In this embodiment two recessed areas or valve seats are formed in the bottom of the toroidal channel and valve plate 8 such that a set of rotating valves 9A and 9B provides a mechanism for regulating the exhaust flow from the exhaust chamber within the toroidal channel located on the top side of the toroidal channel and valve plate 8. The set of rotating valves 9A and 9B consists of a disk with a large radius portion that is less than 180 degrees in circumference such that as the set of rotating valves 9A and 9B rotate, exhaust ports B and C are opened and closed in accordance with the sequence described in FIGS. 1 through 5.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

Other modifications may be made without departing from the ambit of the invention, the nature of which, is to be determined from the foregoing description and the appended claim.

What is claimed is:

1. A rotary machine, comprising:

a flattened, cylindrical flywheel;

a piston secured to the underside of said flywheel;

a main shaft extending through the center of and connected to said flywheel;

a fluid channel bored through said main shaft, said flywheel and said piston for introducing a fluid source to a toroidal channel;

a flattened cylindrical toroidal channel and valve seat plate disposed on the underside of said flywheel, said plate including said toroidal channel for disposing said piston within said toroidal channel, one inlet port entering through the main shaft with a port at the back side of said piston and disposed within the toroidal channel, and two exhaust ports diametrically disposed within said toroidal channel for exhausting fluid from said toroidal channel and providing power to said piston;

a first set of two rotating valves disposed within said recess portion and including a small radius portion and a large radius portion such that, as said valves rotate, said toroidal channel is opened or closed relative to the position of said small radius portion or said large radius portion in relation to said toroidal channel;

a second set of two rotating valves which rotate at the same rate as said first set of two rotating valves such that as said second set of two rotating valves rotates, said exhaust ports are opened or closed relative to the position of said second set of rotating valves in relation to said exhaust ports;

two secondary shafts secured to said rotating valves and connected to said main shaft to provide output power such that said rotating valves rotate at the same rate as said main shaft;

a machine housing, comprising a top plate, a top spacer, said toroidal channel and valve seat plate, a bottom ring and a bottom plate such that said flywheel, said piston, said rotating valves, said secondary shafts and said toroidal channel are all disposed within said housing.

* * * * *